United States Patent [19]

Barth et al.

[11] 4,131,191

[45] Dec. 26, 1978

[54] COIN OPERATED LOCK

[75] Inventors: Douglas A. Barth, Sinclairville; Richard J. Chester, Kennedy, both of N.Y.

[73] Assignee: American Locker Security Systems, Inc., Jamestown, N.Y.

[21] Appl. No.: 834,456

[22] Filed: Sep. 19, 1977

[51] Int. Cl.[2] ..... G07F 1/04

[52] U.S. Cl. ..... 194/92

[58] Field of Search ..... 194/72, 51, 92, DIG. 2

[56] References Cited

U.S. PATENT DOCUMENTS

| | | | |
|---|---|---|---|
| 3,613,855 | 10/1971 | Stackhouse et al. | 194/51 |
| 3,938,640 | 2/1976 | Stackhouse et al. | 194/92 |

*Primary Examiner*—Stanley H. Tollberg

*Attorney, Agent, or Firm*—Bean, Kauffman & Bean

[57] ABSTRACT

In a two coin operated lock unit having a coin operated patron key lock adapted to effect locking of a cabinet door, the improvement featuring the utilization of a coin selector adapted to adjustably accommodate the lock for operation by coins of differing denomination.

7 Claims, 5 Drawing Figures

COIN OPERATED LOCK

BACKGROUND OF THE INVENTION

The present invention relates to an improvement in coin operated locks of the general type disclosed for instance in U.S. Pat. Nos. 2,603,335; 2,634,847; 2,649,949; 3,023,875; 3,077,970; 3,228,506; 3,229,797; 3,599,770; 3,613,855 and 3,938,640, wherein the lock unit includes a coin operated patron lock employed to lock a cabinet door in closed position.

In locks of the type disclosed by each of the above mentioned patents, a coin intercepting finger is arranged to project into a coin chute or guide for the purpose of releasably intercepting and holding a properly sized coin in position in which it may be suitably sensed for permitting rotation of the patron lock into its lock or locking bolt extended position. With the exception of U.S. Pat. Nos. 3,023,875 and 3,077,970, positioning of a coin within the coin chute is sensed by a feeling finger.

In U.S. Pat. Nos. 2,603,335; 2,634,848; 2,649,949; 3,023,875; 3,077,970; 3,229,797 and 3,613,855, the locks are designed to permit two coin operation, but are not readily adjustable to permit the locks to be operated by coins of varying denomination. In U.S. Pat. Nos. 3,228,506 and 3,599,770, the locks have coin intercepting mechanisms, which are readily adjustable in order to accommodate the locks for use with coins of various sizes, but the locks are limited to single coin operations.

In U.S. Pat. No. 3,938,640, the lock may be adjusted to accommodate for both different coin denominations and varying members of coins of each denomination. However, a drawback of this lock is that its vertical and depthwise dimensions exceed the space limitations of large numbers of previously installed locker, thus restricting its use to new locker installations.

SUMMARY OF THE INVENTION

The present invention is directed towards an improved two coin operated lock unit, which may be readily adjusted to accommodate the lock for operation by coins of differing denominations.

The present lock construction features an improved coin selector mechanism including a pivotally supported operating member on which is adjustably supported a selector member having a pair of gauging pawls arranged for engagement with successively deposited coins and cooperating with the guide chute to arrange only a pair of coins of a given denomination for sensing by a feeling finger of the lock unit. Reciprocating adjustments of the selector member relative to the control member accommodates the lock unit to different coin denominations and/or currencies.

An additional feature of the present invention is that the coin chute may be similar in size and placement to the chutes of the lock units described in U.S. Pat. Nos. 3,228,506 and 3,559,770, whereby to permit the present two coin operated lock unit to replace previously installed single coin operated units in this and foreign countries without necessitating changes in the construction of otherwise useable locker units.

DRAWINGS

The present invention will now be described in detail in the following description taken with the accompanying drawings wherein.

DETAILED DESCRIPTION

Figure 1:
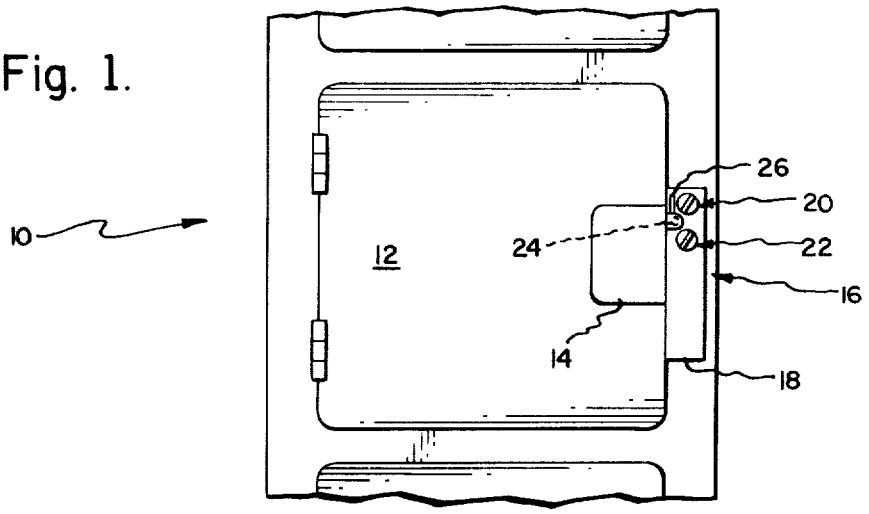
FIG. 1 is a fragmentary front elevational view of a bank of checking lockers or cabinets adapted to receive a lock unit formed in accordance with the present invention; the construction of the checking lockers being conventional and forming no part of the present invention.

Now referring particularly to FIG. 1, 10 designates a bank of coin-control checking cabinets or lockers and 12 indicates a door closure of one of the cabinets on which is fixed a hand gripping block or flange 14 adapted to facilitate opening and closing of the door.

A locking unit 16, which is employed to lock door 12 in closed position, is shown as including a face or front plate 18 to which extends a custodian or control lock 20, a patron lock 22 and a patron lock release rod 24. Face plate 18 is also shown as being apertured to define a coin insertion slot 26, and may if desired, be formed with additional apertures to permit viewing of a suitable counter mechanism, not shown, and to provide for a coin return slot, also not shown.

The various elements forming lock unit 16 are normally mounted on face plate 18, so as to permit the lock unit to be removably secured within an opening, not shown, provided in a marginal portion of the cabinet adjacent door 12. To this end, lock unit 16 is preferably secured in place by cooperation of a face plate bottom lip 30 and a lip 32, which is carried by barrel 34 of a custodian lock 20. Barrel 34 may be rotated by means of a removable custodian control key, not shown, so as to move lip 32 counter-clockwise from its position shown in FIG. 2 in order to enable the whole of the lock unit to be removed from the cabinet.

By again referring to FIG. 2, it will be understood that face plate 18 serves to mount a coin chute or guide 36 such as to position its inlet or upper end in communication with coin insertion slot 26 and its lower or outlet end in communication with a coin collection box, not shown, and/or if desired, a coin return mechanism, also not shown. Chute 36 may be considered as having coin side guiding surfaces 36*a* and 36*b*, which are aligned with the vertically extending side edges of insertion slot 26, and coin edge or front and rear guiding surfaces 36*c* and 36*d*, respectively. A coin slot blocking or constricting member 38 may be removably fixed in association with the inlet end of coin chute 36 in order to selectively control the maximum diameter of a coin, which may be inserted through slot 26. Face plate 18 additionally serves to carry bracket 39, which in turn serves to slideably support a locking bolt 40 for reciprocation between the contracted or cabinet door unlocking position shown in FIG. 2 and the extended or cabinet door locked position shown in FIG. 3.

By again referring to FIG. 2, it will be understood that patron lock 22 includes a cylindrical housing, not shown, which is non-removably carried by face plate 18; a cup-shaped barrel 42, which is rotatably supported on the cylindrical housing; and a lock cylinder, not shown, which is rotatably supported within the cylindrical housing, so as to permit rotation thereof under the control of a patron's key 22a. An end portion 43, which is connected to the rear of the patron lock cylinder, extends through the rear end of the cylindrical housing for driving connection with barrel 42, whereby to permit patron key induced rotations of the lock cylinder to be transmitted to the barrel. The disc 44 is fixed to the forward end of barrel 42 and provided with an arm, not shown, for connecting the barrel to lock bolt 40, such that the lock bolt is moved to an extended-locking position upon rotation of the barrel in a counter-clockwise direction, as viewed in FIGS. 2 and 3. A disc 46, which is also carried on the forward end of barrel 42, is notched to provide a shoulder 48 adapted to cooperate with a pawl 50, which is in turn pivotally supported by a pin shaft 52. A spring 54 serves to normally bias pawl 50 radially into contact with disc 46 for engagement with shoulder 48. When barrel 42 is in its normal unlocked position shown in FIG. 2, a non-illustrated, high-peripheral portion of disc 46 engages with pawl 50, so as to position the latter radially outwardly of shoulder 48. However, when barrel 42 is rotated in a counter-clockwise direction, as viewed in FIG. 2, spring 54 pivots pawl 50 inwardly, whereupon shoulder 48 engages the pawl and limits further rotation of the barrel in the absence of there being a pair of proper denomination coins supported and properly positioned within coin chute 36 by an intercepting or selector mechanism 60 cooperating with the lower end portion of surface 36c. When such coins are positioned within the coin chute, a coin feeler finger 62, which is formed integrally with pawl 50 and freely insertable through coin chute opening 64, engages with an aligned coin and serves to hold pawl 50 in a position radially outwardly of shoulder 48, so as to permit shoulder 48 to move past the pawl as barrel 42 is rotated into its door locking position shown in FIG. 3.

A cylindrical stop device 66 mounted on release rod 24 is biased for receipt within side opening recesses 68 formed in discs 44 and 46 in order to normally constrain barrel 42 against rotation from its unlocked position. However, when door 12 is closed, rod 24 is depressed to remove stop device 66 from within recesses 68.

As thus far generally described, lock unit 16 is quite similar in structure and the mode of operation to the units described in the above mentioned U.S. Pat. Nos. 3,228,506; 3,599,770 and 3,938,640 to which reference may be made for a more complete description of this type of lock unit. Moreover, mechanism 60 is similar to that described in U.S. Pat. No. 3,599,770 from the standpoint that it generally includes an operator member in the form of a lever 70, which is pivotally mounted on coin chute 36, as by pivot pin 72, and a coin selector member 74, which is adjustably fixed to lever 70; and in that lever 70 terminates at its upper end in a forwardly projecting finger or cam follower 76, which is arranged for operative sliding engagement with the rear surface 78 of barrel 42 and is formed with an abutment edge surface 80 engageable with a stop 82 carried by coin chute 36. Such surface 78 is characterized as having a flat or radially extending portion 78a and a forwardly inclined or cam portion 78b. Further, as in the case of the prior construction, when the patron lock is arranged in its door unlocked position shown in FIG. 2, finger 76 engages with surface portion 78a and edge surface 80 engages with stop 82 in order to constrain counter-clockwise and clockwise directed rotations, respectively, of lever 70 and selector member 74 about the axis of pin 72. When barrel 42 is rotated into locked position, cam portion 78b is placed in alignment with finger 76 in order to free lever 70 and selector member 74 for movement into their positions shown in FIG. 3, this serving to remove selector member 74 from supporting engagement with coins within chute 36, thereby permitting gravity induced discharge of coins from the chute.

Mechanism 60 departs from prior constructions of the type disclosed for instance in U.S. Pat. No. 3,599,770 in the construction of selector member 74, the manner in which it is adjustably supported on operator member 70 and in its capability of providing lock unit 16 with a two coin operating capability. A particularly important advantage of the present construction is that it provides for two coin operations in selected currencies by means of adjustments limited solely to the mechanism.

More specifically, selector member 74 is shown in the drawings as being formed with a pair of gauging pawls including a lower gauging or coin supporting pawl 90 and an upper gauging or coin positioning pawl 92, which are arranged to freely extend into the confines of coin chute 36 through side wall cutout 94. Selector member 74 is mounted for sliding, stepwise adjustments relative to lever 70 by means of a clamping rivet or screw device 96 whose shank portion slideably extends through slot 98 of the selector member for attachment to the lever and serves to selectively maintain a punched out dimple or projection 100 of the selector member seated within a desired one of a plurality of recesses or openings 102 formed in the lever. Lever 70 is also preferably formed with an upturned flange 104, which serves to constrain rotation of selector member 74 relative to the lever about the axis of device 96 and removal of dimple 100 from its opening 102, due to engagement of coins with lower pawl 90.

Figure 3:
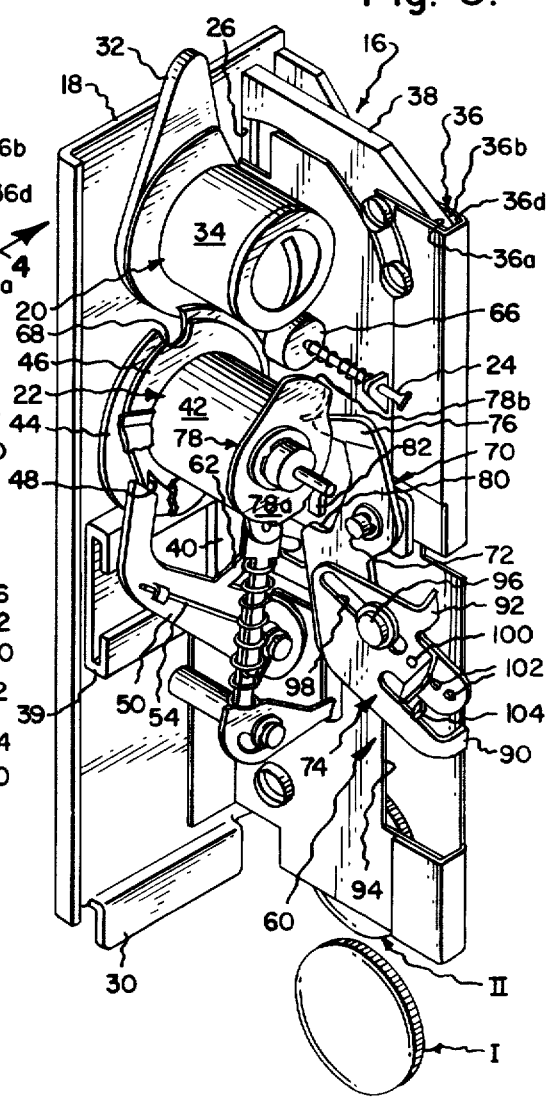
FIG. 3 is a perspective view similar to FIG. 2 but showing the lock unit in cabinet door locked condition.
Figure 4:
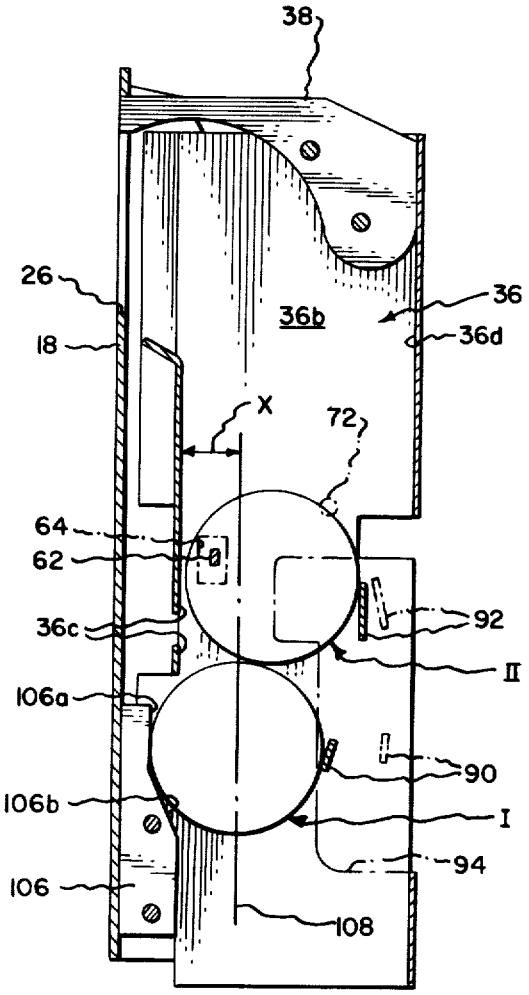
FIGS. 4 and 5 are fragmentary views of a lock chute showing coins of varying denominations supported therein.

In the drawings, selector member 74 is shown as being adjustably fixed relative to lever 70 in order to accommodate lock unit 16 for operation by two U.S. quarters, which are designated as "I" and "II" in FIGS. 3 and 4. However, it will be understood that mechanism 60 is adapted to be adjusted for operation with given denomination coins of other currencies, such as French "Francs" and German "Marks" by selectively seating dimple 100 within an appropriate one of openings 102. In any event, an appropriately sized coin slot blocking member 38 would be employed to limit the size of coin slot 26, such as to prevent insertion of any coins having a diameter exceeding the diameter of a given denomination coin for which mechanism 60 has been set.

Figure 2:
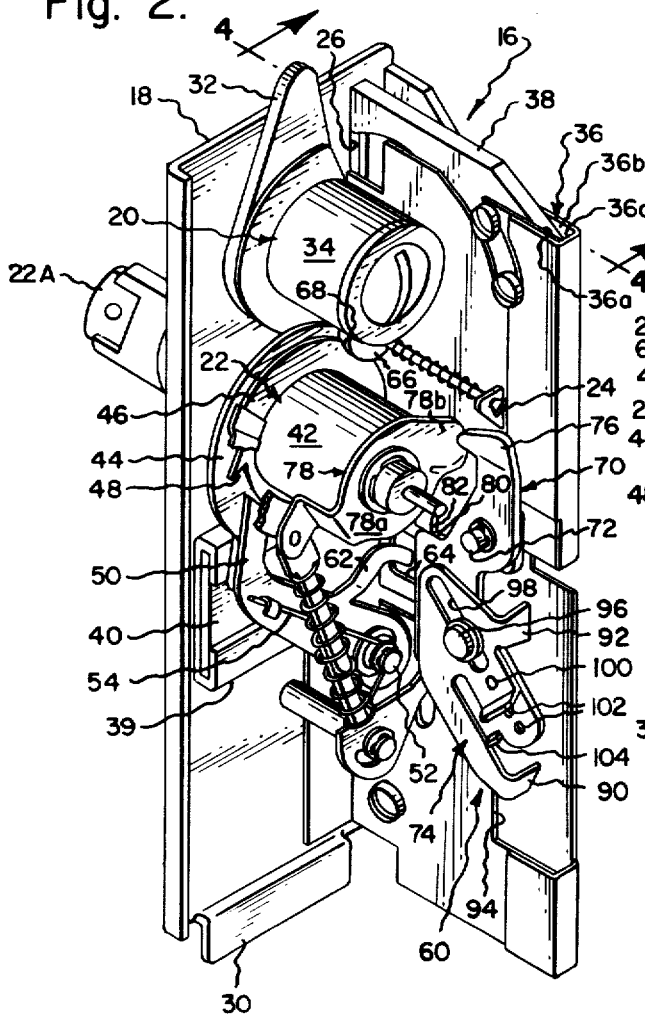
FIG. 2 is a perspective view of the lock unit employed in the present invention in its cabinet door unlocked condition.

Operation of mechanism 60 will now be described with particular reference to FIGS. 4 and 5, wherein pawls 90 and 92 are shown in full line in the positions that they occupy when lock unit 16 is in its unlocked condition shown in FIG. 2. Gauging pawls 90 and 92 may occupy the positions shown in broken line in FIG. 4 incident to positioning of the lock unit in its locked condition shown in FIG. 3.

Also, with reference to FIG. 4, it will be noted that the present invention features a modified stationary gauging means in the form of a bar or insert 106 serving to define a vertically extending gauging surface 106a, which is disposed in a forwardly offset and essentially parallel relationship relative to surface 36c, and a downwardly and rearwardly inclined clearance surface 106b. The spacing between lower gauging pawl 90 and gauging surface 106a, which is established by dimple 100 and a given one of openings 102, is such as to arrest downward movement of the first deposited given denomination coin "I" and support same in its illustrated gauging position, while permitting any previously deposited coin, not shown, having a diameter less than the diameter of coin "I" to freely pass downwardly between surfaces 106*a* and 106*b* and pawl 90 and then through the discharge end of coin chute 36. If a second given denomination coin "II" is subsequently inserted, it will be supported by edge-to-edge engagement with coin "II," and edge-to-surface engagement with upper pawl 92. When so supported, a portion of coin "II" is disposed for alignment with coin feeler 62 in order to permit rotation of barrel 42 between the positions illustrated in FIGS. 2 and 3 in the manner described above.

If through error or design, a patron should deposit U.S. coins of denominations other than the given denomination, e.g. a dime "II*a*," a penny "II*b*" or a nickel "II*c*," after first depositing coin "I," such coins and/or any additionally deposited coin will not be aligned for engagement by feeler finger 62, and lock unit 16 thereby rendered inoperative.

Figure 5:
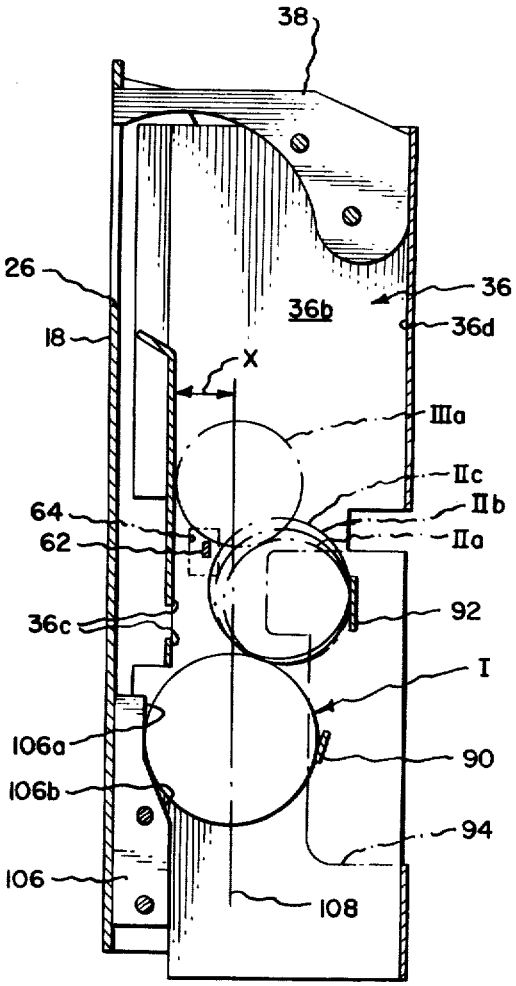

FIG. 5 illustrates the situation wherein any one of improper coins "II*a*," "II*b*" or "II*c*" is deposited and supported by edge-to-edge engagement with coin "I" and edge-to-surface engagement with upper pawl 92. In each case, the improper coin is supported in a non-aligned relationship relative to feeler finger 62. Any subsequently deposited coin, such as an improper coin in the form of a dime "III*a*" will be supported by edge-to-edge engagement with the previously deposited improper coin, e.g. dime "II*a*," and normally forced to roll forwardly into edge-to-surface engagement with chute front surface 36*c*, so that it too would be supported in a non-aligned relationship relative to the feeler finger. When an improper coin is deposited and supported in coin chute 36 in the manner described above, the lock unit is rendered inoperative and must be cleared by a custodian.

From the foregoing, it will be understood that lower pawl 90, when in its operative position, is necessarily spaced horizontally relative to surface 106*a* through a distance permitting passage therebetween of improper coins, while arresting passage of a first deposited coin of a given denomination. Pawl 90 is also necessarily spaced vertically relative to feeler finger 62, so that coin "I" is vertically positioned, as required to support coin "II" for alignment with the feeler finger when engaged with upper pawl 92, and to support any of coins "II*a*," "II*b*," "II*c*" so as to insure that none of such coins and/or coin "III*a*" is disposed in an aligned relationship relative to the feeler finger when in engagement with pawl 92 in the manner described above. On the other hand, pawl 92 is required to be spaced horizontally relative to chute front surface 36*c* and/or feeler finger 62 through a distance permitting proper alignment of coin "II," while preventing alignment of any of coins "II*a*," "II*b*," "II*c*" or "III*a*" with the feeler finger when any of coins "II*a*," "II*b*" or "II*c*" are disposed in engagement therewith.

The foregoing placement of coins is accomplished in the case of any specified currency by insuring that coin "I" is supported in a forwardly offset relationship relative to chute front surface 36*c* by an amount sufficient to insure that the distance or spacing "x," as measured horizontally between front surface 36*c* and a line 108 drawn vertically through the center of coin "I," is slightly less than one-half the diameter of the smallest improper coin of such currency, e.g. a dime "II*a*" in U.S. currency for the case where mechanism 60 is adjusted or set to accommodate quarters "I" and "II." With the foregoing arrangement, all coins deposited immediately after coin "I" will be forced to roll rearwardly into engagement with upper pawl 92 and with the exception of coin "II" away from alignment with feeler 62; the spacing of pawl 92 from front surface 36*c* being sufficient to permit this to occur, while at the same time limiting rolling displacement of improper coins to insure that a subsequently disposed improper coin, i.e. coin "III*a*," which may roll forwardly into contact with front surface 36*c*, does not align itself with feeler 62.

It will also be understood that means other than a stationary, vertically disposed surface 106*b* may be employed in cooperation with lower pawl 90 to provide edge support for coin "I." However, illustrated gauging surface is preferred in that it provides a continuous gauging surface accommodating for different settings of selector member 74 relative to operator member 70.

The exact positional relationships referred to above may be readily determined for any given currency having common disc shaped coins, as for instance the currencies of Belgium, Denmark, France, Holland, Norway, Sweden, Switzerland, United States and Western Germany.

We claim:

1. In a coin operated lock of the type having a coin chute formed with vertically spaced coin inlet and discharge ends and being bounded at least in part by a pair of vertically extending coin edge guiding surfaces and a pair of vertically extending coin side guiding surfaces for constraining coins to move on edge downwardly therethrough, means for limiting passage of coins through said inlet end to coins of a diameter equal to or less than the diameter of a given denomination coin of a given currency intended to operate said lock, a stationary gauging means arranged relatively adjacent said discharge end, a coin selector mechanism arranged relatively adjacent said discharge end and when in a gauging position thereof cooperating with said gauging means for releasably supporting at least certain of the coins deposited in said chute and a coin feeler arranged relatively adjacent said inlet end and removably insertable into said chute adjacent one of said edge guiding surfaces for sensing the presence of a coin supported in said chute in alignment therewith, characterized in that said lock may be moved from an unlocked into a locked condition only upon the sensing of the presence of a coin by said coin feeler whereafter said coin selector mechanism is moved to a release position for releasing coins retained in said chute for discharge through said discharge end, the improvement for accommodating said lock for operation by two coins of said given denomination, which comprises in combination:

said selector mechanism includes first and second gauging pawls movable between said gauging and release positions, said first pawl being arranged relatively adjacent said discharge end of said chute and when in said gauging position cooperating with said gauging means to support a first deposited coin of said given denomination therewithin while permitting passage of previously deposited improper coins of said given currency having a diameter less than said diameter of said given denomination coin downwardly through said discharge end, said second pawl being disposed relatively above said first pawl and when in said gauging position being spaced from said one of said edge guiding surfaces a distance in excess of said diameter of said given denomination coin, characterized in that placement of said pawls relative to one another, said one of said edge guiding surfaces, said gauging means and said coin feeler provides for alignment with said coin feeler of a second deposited coin of said given denomination while edge-to-edge supported by said first deposited coin and in edge-to-surface engagement with said second pawl and prevents alignment with said coin feeler of subsequently deposited improper coins of said currency while edge-to-edge supported by said first deposited coin and in edge-to-surface engagement with said second pawl or when edge-to-edge supported by one of said subsequently deposited improper coins and in edge-to-surface engagement with said one of said guiding surfaces.

2. An improvement according to claim 1, wherein said gauging means is a gauging surface disposed essentially parallel to said one of said edge guiding surfaces and arranged to provide edge-to-surface support for said first deposited coin at a point outwardly of said one of side edge guiding surfaces in a direction away from the other of said coin edge guiding surfaces, said selector mechanism includes an operator member pivotally supported on said coin chute and a selector member carrying said first and second pawls and being adjustably fixed to said operator member for reciprocating movements to accommodate said lock for operation by given denomination of coins of different currencies differing one from another in diameter, said operator member being responsive to movement of said lock between said unlocked and locked condition for effecting movement of said first and second pawls between said gauging and release positions.

3. An improvement according to claim 1, wherein said selector mechanism includes means to simultaneously vary placement of said first and second pawls when in said gauging position relative to said gauging means, said one of said edge guiding surfaces and said coin feeler.

4. In a coin operated lock of the type having a coin chute formed with vertically spaced coin inlet and discharge ends and being bounded at least in part by vertically extending front and rear coin edge guiding surfaces and vertically extending coin side guiding surfaces for constraining coins to move on edge downwardly therethrough, means for limiting passage of coins through said inlet end to coins of a diameter equal to or less than the diameter of a given denomination coin of a given currency intended to operate said lock, a stationary gauging means arranged relatively adjacent said discharge end, a coin selector mechanism arranged relatively adjacent said discharge end and when in a gauging position cooperating with said gauging means for releasably supporting at least certain of the coins deposited in said chute and a coin feeler arranged relatively adjacent said inlet end and removably inserted into said chute adjacent said front edge guiding surface for sensing the presence of a coin supported in said chute in alignment therewith, characterized in that said lock may be moved from an unlocked into a locked condition only upon the sensing of the presence of a coin by said coin feeler whereafter said coin selector mechanism is moved to a release position for releasing coins supported in said chute for discharge through said discharge end, the improvement for accommodating said lock for operation by two coins of said given denomination, which comprises in combination:

said selector mechanism having upper and lower pawls movable between said gauging and release positions, said lower pawl when in said gauging position cooperating with said gauging means to releasably support a first deposited coin of said given denomination within said chute in a gauging position providing for alignment with said coin feeler of a second deposited coin of said given denomination when edge-to-edge supported with said first deposited coin and edge-to-surface engaged with said upper pawl, said lower pawl being spaced from said gauging means sufficiently to permit passage downwardly through said chute of previously deposited improper coins having diameters less than the diameter of said given denomination coin, said upper pawl being disposed relatively above said lower pawl and spaced from said front edge guiding surface through a distance in excess of said diameter of said given denomination coin and to provide for alignment with said coin feeler of said second deposited coin of said given denomination when edge-to-edge supported by said first deposited coin and in edge-to-surface engagement with said upper pawl and to prevent alignment with said coin feeler of subsequently deposited improper coins when edge-to-edge supported by said first deposited coin and in edge-to-surface engagement with said upper pawl or when edge-to-edge supported by a previously deposited improper coin and in edge-to-surface engagement with said front edge guiding surface.

5. In a coin operated lock of the type having a coin chute formed with vertically spaced coin inlet and discharge ends and being bounded at least in part by vertically front and rear coin edge guiding surfaces and vertically extending coin side guiding surfaces for constraining coins to move on edge downwardly therethrough, means for limiting passage of coins through said inlet end to coins of a diameter equal to or less than the diameter of a given denomination coin of a given currency intended to operate said lock, a stationary coin gauging means arranged relatively adjacent said discharge end, a coin selector mechanism arranged relatively adjacent said discharge end and when in a gauging position cooperating with said gauging means for releasably supporting at least certain of the coins deposited in said chute and a coin feeler arranged relatively adjacent said inlet end and removably inserted into said chute adjacent said front edge front edge guiding surface for sensing the presence of a coin supported in said chute in alignment therewith, characterized in that said lock may be moved from an unlocked into a locked condition only upon the sensing of the presence of a coin by said coin feeler whereafter said coin selector mechanism is moved to a release position for releasing coins supported in said chute for discharge through said discharge end, the improvement for accommodating said lock for operation by two coins of said given denomination, which comprises in combination:

said selector mechanism including upper and lower gauging pawls movable between said gauging and release positions, said lower pawl when in said gauging position cooperating with said gauging means to support a first deposited coin of said given denomination in a gauging position with said chute while permitting passage of previously deposited improper coins of said currency having a diameter less than said diameter of said given denomination coin downwardly through said discharge end, said first deposited coin when in said gauging position being arranged in a forwardly offset relationship relative to said front coin guiding surface wherein the distance between said front coin edge guiding surface and a line drawn vertically through the center of said first deposited coin is less than one-half the diameter of the smallest of said improper coins, said upper pawl being disposed relatively above said lower pawl and when in said gauging position being spaced from said front guiding surface a distance in excess of said diameter of said given denomination coin, characterized in that placement of said pawls relative to one another, said gauging means, said front edge guiding surface and said coin feeler provides for alignment with said coin feeler of a second deposited coin of said given denomination when edge-to-edge supported by said first deposited coin and in edge-to-surface engagement with said upper pawl and prevents alignment with said coin feeler of subsequently deposited improper coins when edge-to-edge supported by said first deposited coin and in edge-to-surface engagement with said upper pawl or when edge-to-edge supported by one of said subsequently deposited impropr coins and in edge-to-surface engagement with said front edge guiding surface.

6. An improvement according to claim 5, wherein said gauging means is defined by a gauging surface disposed forwardly of said front edge guiding surface and arranged essentially parallel relative thereto.

7. An improvement according to claim 6, wherein said selector mechanism includes an operator member pivotally supported on said coin chute and a selector member carrying said upper and lower pawls and being adjustably fixed to said operator member for reciprocating movements to accommodate said lock for operation by given denominations of coins of different currencies differing one from another in diameter, said operator member being responsive to movement of said lock between said unlocked and locked condition for effecting movement of said upper and lower pawls between said gauging and release positions.

* * * * *